US012385322B2

(12) United States Patent
Bedouet

(10) Patent No.: US 12,385,322 B2
(45) Date of Patent: Aug. 12, 2025

(54) MODULAR ROTARY STEERABLE SYSTEM

(71) Applicant: OnTarget Drilling, LLC, Houston, TX (US)

(72) Inventor: Sylvain Bedouet, Houston, TX (US)

(73) Assignee: OnTarget Drilling, LLC, Houston, TX (US)

( * ) Notice: Subject to any disclaimer, the term of this patent is extended or adjusted under 35 U.S.C. 154(b) by 39 days.

(21) Appl. No.: 18/463,687

(22) Filed: Sep. 8, 2023

(65) Prior Publication Data

US 2025/0084703 A1 Mar. 13, 2025

(51) Int. Cl.
*E21B 7/04* (2006.01)
*E21B 44/00* (2006.01)

(52) U.S. Cl.
CPC ..... *E21B 7/04* (2013.01); *E21B 44/00* (2013.01)

(58) Field of Classification Search
CPC ... E21B 7/04; E21B 44/00; E21B 7/06; E21B 7/062; E21B 7/067; E21B 7/10
See application file for complete search history.

(56) References Cited

U.S. PATENT DOCUMENTS 1,083,004 A 12/1913 Davidson
4,637,479 A 1/1987 Leising
5,186,264 A 2/1993 Du Chaffaut
5,265,682 A 11/1993 Russell et al.
5,332,048 A * 7/1994 Underwood ..... E21B 44/005 175/26
5,520,255 A 5/1996 Barr et al.
5,553,678 A 9/1996 Barr et al.
5,582,259 A 12/1996 Barr
5,695,015 A 12/1997 Barr et al.
5,947,213 A * 9/1999 Angle ..... E21B 23/00 166/255.2

(Continued)

FOREIGN PATENT DOCUMENTS

CA 2547036 A1 11/2006
CA 2170183 C 1/2007

(Continued)

OTHER PUBLICATIONS

International Search Report and Written Opinion, mailed Oct. 24, 2024, for corresponding International Patent Application No. PCT/US2024/042492.

(Continued)

*Primary Examiner* — Daniel P Stephenson
(74) *Attorney, Agent, or Firm* — Jones Walker LLP

(57) ABSTRACT

A rotary steerable system including a steering section and a control section. The control section includes a modular control system that is field detachable from a remainder of the control section. The modular control system includes one or more modules that are field detachable from the other modules and a remainder of the modular control system. Examples of the modules of the modular control system include a power module configured to generate electrical power or electromagnetic field rotation from hydraulic power, a control module configured to control actuation of one or more pistons in the steering section, and/or a flow control module configured to selectively allow fluid flow into one or more distribution channels leading to the one or more pistons of the steering unit.

22 Claims, 8 Drawing Sheets

(56) References Cited

U.S. PATENT DOCUMENTS

| | | | | |
|---|---|---|---|---|
| 6,089,332 | A | 7/2000 | Barr et al. | |
| 6,158,529 | A * | 12/2000 | Dorel | E21B 7/067 175/61 |
| 6,467,557 | B1 | 10/2002 | Krueger et al. | |
| 7,057,316 | B2 | 6/2006 | Spring | |
| 7,133,325 | B2 | 11/2006 | Kotsonis et al. | |
| 7,141,901 | B2 | 11/2006 | Spring | |
| 7,378,985 | B2 | 5/2008 | Spring | |
| 7,503,405 | B2 | 3/2009 | Hall et al. | |
| 8,869,916 | B2 | 10/2014 | Clausen et al. | |
| 9,016,400 | B2 | 4/2015 | Clausen et al. | |
| 9,187,956 | B2 | 11/2015 | Hutton et al. | |
| 9,624,727 | B1 | 4/2017 | Hutton | |
| 9,869,140 | B2 | 1/2018 | Rushton | |
| 10,655,447 | B2 * | 5/2020 | Tilley | C09K 8/66 |
| 11,326,437 | B2 * | 5/2022 | Tchakarov | E21B 47/022 |
| 11,913,335 | B2 * | 2/2024 | Peters | E21B 7/06 |
| 11,952,894 | B2 | 4/2024 | Bedouet | |
| 11,970,942 | B2 | 4/2024 | Bedouet | |
| 2001/0042643 | A1 | 11/2001 | Krueger et al. | |
| 2001/0052428 | A1 | 12/2001 | Larronde | |
| 2002/0011358 | A1 | 1/2002 | Wassell | |
| 2002/0112892 | A1 | 8/2002 | Taylor | |
| 2005/0056421 | A1 | 3/2005 | Homan et al. | |
| 2005/0109542 | A1 | 5/2005 | Downton | |
| 2006/0243487 | A1 | 11/2006 | Turner et al. | |
| 2006/0263215 | A1 | 11/2006 | Sindt et al. | |
| 2012/0061148 | A1 | 3/2012 | Clausen et al. | |
| 2012/0160565 | A1 | 6/2012 | Downton | |
| 2013/0118812 | A1 | 5/2013 | Clausen et al. | |
| 2014/0110178 | A1 | 4/2014 | Savage et al. | |
| 2016/0002978 | A1 | 1/2016 | Rushton | |
| 2018/0128060 | A1 | 5/2018 | Haugvaldstad | |
| 2018/0202279 | A1 | 7/2018 | Moriarty et al. | |
| 2020/0080381 | A1 | 3/2020 | Hardin, Jr. | |
| 2020/0318437 | A1 | 10/2020 | Gray | |
| 2020/0325731 | A1 | 10/2020 | Chambers et al. | |
| 2021/0198949 | A1 | 7/2021 | Haugvaldstad et al. | |
| 2022/0282571 | A1 | 9/2022 | Bedouet | |
| 2025/0084703 | A1 * | 3/2025 | Bedouet | E21B 7/04 |

FOREIGN PATENT DOCUMENTS

| | | | |
|---|---|---|---|
| CN | 105239924 | A | 1/2016 |
| GB | 2426265 | A | 11/2006 |
| WO | 2002091553 | A1 | 11/2002 |
| WO | 2019190484 | A1 | 10/2019 |
| WO | 2020018816 | A1 | 1/2020 |

OTHER PUBLICATIONS

Schlumberger, "NeoSteer CLx, Extreme curve and lateral at-bit steerable system," 2019.

Schlumberger, "PowerDrive Orbit, Rotary steerable system," 2016.

Scientific Drilling, Halo Technical Data Sheet, 2018.

Dexter Magnetic Technologies, Inc., "Final Report: Development of a High Pressure/High Temperature Don-hole Turbine Generator," Oil & Natural Gas Technology, 2010.

D-Tech Rotary Steerable, "D-Tech RST—Engineered for Maximum Performance Through Superior Reliability," 2020.

Halliburton, "iCruise® Intelligent Rotary Steerable System," 2019.

Co-pending U.S. Appl. No. 17/682,127, filed Feb. 28, 2022, titled "Dual Piston Rotary Steerable System."

Co-pending U.S. Appl. No. 17/682,503, filed Feb. 28, 2022, titled "Rotary Steerable System With Central Distribution Passages."

Co-pending U.S. Appl. No. 18/463,795, filed Sep. 8, 2023, titled "Self-Contained Compact Rotary Steerable System."

Application (including specification, drawings, and claims) from applicant's co-pending U.S. Appl. No. 18/463,795, filed Sep. 8, 2023, titled "Self-Contained Compact Rotary Steerable System."

* cited by examiner

MODULAR ROTARY STEERABLE SYSTEM

BACKGROUND

In the process of drilling and producing oil and gas wells, rotary steerable systems are used to control and adjust the direction in which a well is drilled. Conventional rotary steerable systems are typically over 150 inches in length. These large systems require frequent maintenance. The conventional rotary steerable systems' long length presents challenges in the maintenance, including the need to transport the system from a drilling location to a shop for disassembly and repair.

BRIEF DESCRIPTION OF THE DRAWING VIEWS

DETAILED DESCRIPTION OF SELECTED EMBODIMENTS

Disclosed herein is a rotary steerable system including a modular control system. The modular control system is field detachable from the remainder of the rotary steerable system. The modular control system includes one or more modules that are each field detachable from the other modules and from the remainder of the rotary steerable system. As used herein, "field detachable" means that a system, module, unit, or part is connected to other parts with only mechanical connections that are easily detached without any tools or with only hand tools, and that the system, module, unit, or part has no electrical connections to any other system, module, unit, or part. As used herein, "modular" and "module" each means that a system, unit, or part is field detachable from all other systems, units, and parts.

FIGS. 1-10 illustrate various configurations and embodiments of the rotary steerable system disclosed herein, with many other configurations and embodiments within the scope of the claims being readily apparent to skilled artisans after reviewing this disclosure.

Figure 1:
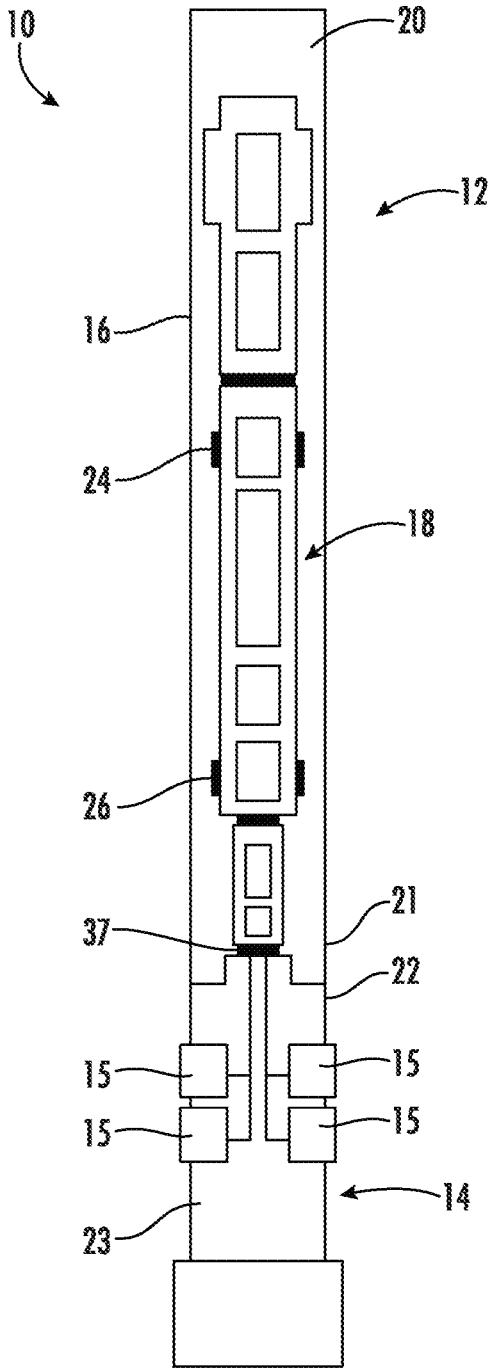
FIG. 1 is a schematic view of the rotary steerable system of the present invention.

With reference to FIG. 1, rotary steerable system 10 includes control section 12 and steering section 14, each having a generally cylindrical shape. Steering section 14 may be configured to control and adjust the direction in which a well is drilled. As one skilled in the art will recognize, steering section 14 may include any mechanism for controlling and adjusting the direction in which a well is drilled. For example, steering section 14 may include actuating pistons 15 as described in U.S. patent application Ser. No. 17/682,127, filed on Feb. 28, 2022, which is hereby incorporated by reference in its entirety. Control section 12 may be configured to selectively activate the actuating pistons 15 in steering section 14. As used herein, "piston" means any structure configured to extend when activated in a radial direction from a tool to which it is secured or in which it is incorporated, including but not limited to a pad, a wedge arrangement, and a cam arrangement.

Control section 12 includes control sleeve 16 and modular control system 18 disposed within cavity 20 of control sleeve 16. Modular control system 18 is configured for rotation relative to control sleeve 16. In one embodiment, modular control system 18 is configured to remain stationary with respect to a surrounding subterranean formation, such that control sleeve 16 rotates around modular control system 18. In other words, modular control system 18 may be configured to remain geo-stationary. Lower end 21 of control sleeve 16 is secured to upper end 22 of steering housing 23 of steering section 14. In this way, control sleeve 16 is rotationally secured to steering housing 23. As used herein, "rotationally secured" means secured together such that two components rotate together (i.e., there is no relative rotation between two components under normal operating conditions).

Referring again to FIG. 1, modular control system 18 may be removably secured within cavity 20 of control sleeve 16 by an easily detachable mechanical connection. In some embodiments, modular control system 18 is removably secured within cavity 20 of control sleeve 16 by one or more fasteners. In the illustrated embodiment, fasteners 24 and 26 removably secure modular control system 18 within cavity 20 of control sleeve 16. In some embodiments, fasteners 24 and 26 are rotationally secured to control sleeve 16, while modular control system 18 rotates relative to fasteners 24 and 26. Alternatively, fasteners 24 and 26 may be rotationally secured to modular control system 18, with fasteners 24 and 26 rotating with modular control system 18 relative to control sleeve 16. In other embodiments, fasteners 24 and 26 include one or more parts that are rotationally secured to modular control system 18 and one or more parts that are rotationally secured to control sleeve 16. In still other embodiments, fasteners 24 and 26 may each include a mechanism secured to control sleeve 16 and a guide for stabilizing modular control system 18 as it rotates relative to control sleeve 16. In order to remove modular control system 18 from control sleeve 16, the user need only remove the one or more fasteners securing modular control system 18 to control sleeve 16 by using only a hand tool, such as a wrench. Once the fasteners are removed, modular control system 18 may then be entirely removed from control sleeve 16. In this way, modular control system 18 is field detachable and modular.

Figure 2:
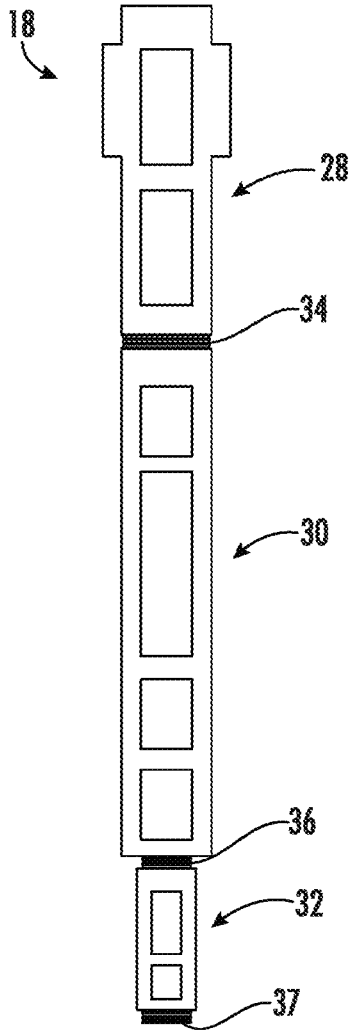
FIG. 2 is a schematic view of a first configuration of a modular control system of the rotary steerable system.

As shown in FIG. 2, modular control system 18 may include one or more modules that are easily detached or removed from one another and from the other components of the rotary steerable system. In other words, the modules of modular control system 18 are field detachable. In the illustrated embodiment, modular control system 18 includes power module 28, control module 30, and flow control module 32. In other embodiments, the modular control system may include any number of modules, such as between 1 and 10 modules, arranged in any order. For example, in the embodiment depicted in FIGS. 1-3, power module 28 may be disposed upstream of control module 30, and control module may be disposed upstream of flow control module 32. In alternate embodiments, the power module may be disposed downstream of the control module.

Power module 28 and control module 30 may be selectively connected at first connection 34. First connection 34 may be defined by a downstream end of power module 28 and an upstream end of control module 30. First connection 34 may be a mechanical connection. For example, first connection 34 may be a radial and thrust bearing connection. It may allow power module 28 to rotate relative to control module 30. Power module 28 and control module 30 may be detached from one another by simply sliding the two modules apart without any tools. In this way, first connection 34 between power module 28 and control module 30 is field detachable and power module 28 is modular.

Control module 30 and flow control module 32 may be selectively connected at second connection 36. Second connection 36 may be defined by a downstream end of control module 30 and an upstream end of flow control module 32. Second connection 36 may be a mechanical connection. For example, second connection 36 may be a threaded connection, a shouldered cylinder-guided connection with a removable locking mechanism that prevents rotation and axial movement (e.g., a removable pin or set screw). Flow control module 32 may be detached from control module 30 using only hand tools, such as a wrench and vise.

Flow control module 32 may be selectively connected to steering section 14 at third connection 37 (also shown in FIG. 1). Third connection 37 may be defined by a downstream end of flow control module 32 and an upstream portion of steering section 14 (shown in FIG. 1). Third connection 37 may be a mechanical connection. For example, third connection 37 may be formed by a flat surface contact between the downstream end of flow control module 32 and the upstream portion of steering section 14. Alternatively, third connection 37 may be formed of any reciprocally shaped surfaces on downstream end of flow control module 32 and an upstream portion of steering section 14 that allow relative rotation between the two modules, such as reciprocal conical surfaces, reciprocal curved surfaces, or reciprocal cylindrical surfaces (i.e., a sliding cylinder contact). Flow control module 32 may be detached from steering section 14 by simply separating flow control module 32 from steering section 14 without any tools, such as by removing assembled modular control system 18 from control sleeve 16.

Figure 3:
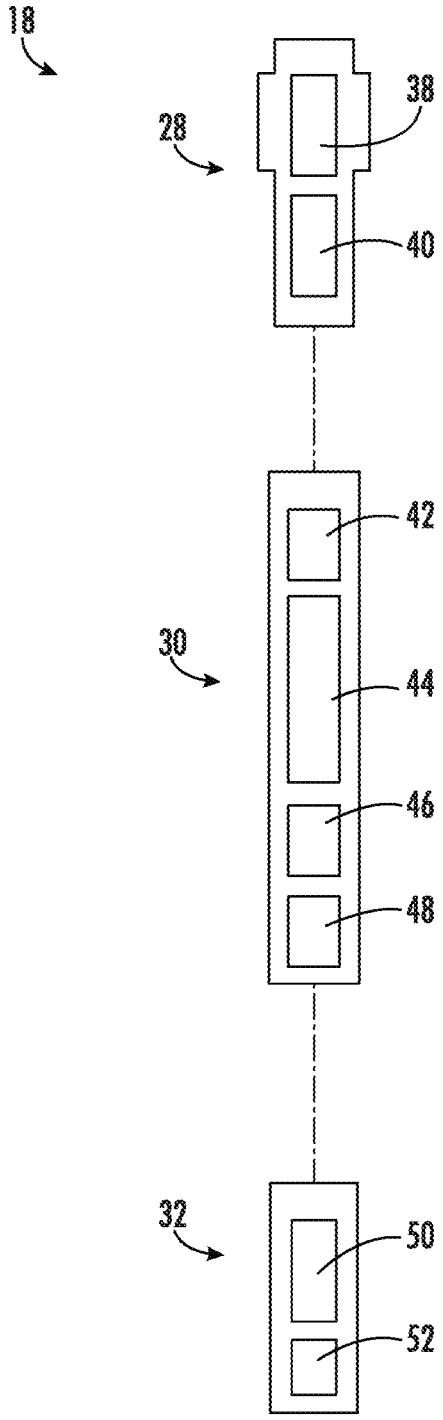
FIG. 3 is a schematic view of separated modules of the modular control system's first configuration.

With reference to FIG. 3, power module 28 may include power unit 38 and actuation unit 40. Power unit 38 may be configured to provide power to rotary steerable system 10 by, for example, converting mechanical hydraulic power to electromagnetic field rotation and/or electrical power. In some embodiments, power unit 38 includes a turbine with an impeller or a positive displacement motor. Actuation unit 40 may be configured to actuate modular control system 18 by rotating modular control system 18 relative to control sleeve 16 or by adjusting the rotation rate of modular control system 18 relative to control sleeve 16. In some embodiments, actuation unit 40 may include a magnetic brake or a contact brake (e.g., a clutch system). Actuation unit 40 may actuate modular control system 18 in response to rotation or power generated by power unit 38.

Referring again to FIG. 3, control module 30 may include communication unit 42, power supply unit 44, control unit 46, and navigation sensor unit 48. Communication unit 42 may be configured to provide communication to and from the rotary steerable system. In other words, communication unit 42 may transmit messages to other tools within the wellbore, such as a measurement-while-drilling tool, and receive downlink messages from the surface. In certain embodiments, communication unit 42 may include an antenna or piezoelectric sensors and actuators for acoustic telemetry. Power supply unit 44 may be configured to power one or more units within control module 30 or other units within modular control system 18 without any physical electrical connections or wires between modules. In certain embodiments, power supply unit 44 may include a turbine or a positive displacement motor. Control unit 46 may be configured to adjust the position of modular control system 18 relative to steering section 14, which in turn controls actuation of the pistons of steering section 14. For example, control unit 46 may be configured to actuate power module 28 to orient a valve in a desired angular direction. Alternatively, control unit 46 may be configured to adjust an actuator in actuation unit 40 based on measurements taken by sensors in navigation sensor unit 48. Navigation sensor unit 48 may be configured to detect an orientation of the rotary steerable system in a magnetic field or in a gravitational field relative to the surface. In certain embodiments, navigation sensor unit 48 may include a magnetometer for sensing a north-south direction, an accelerometer for sensing inclination, or a gyroscope for sensing rotation of the control unit relative to a surrounding subterranean formation.

With reference still to FIG. 3, flow control module 32 may include filter unit 50 and flow distribution unit 52. Flow distribution unit 52 may be configured to divert a portion of the drilling fluid flowing through modular control system 18 into one or more distribution passages within steering section 14 in order to actuate the pistons 15. In some embodiments, flow distribution unit 52 may include any mechanism for selectively diverting fluid flow, such as a valve, a rotating valve segment, a flap, a sliding sleeve arrangement, or a rotating sleeve arrangement. Filter unit 50 may be configured to filter drilling fluid flowing therethrough, such as the drilling fluid diverted by flow distribution unit 52. Filter unit 50 may include any combination of components configured to filter solid particles from drilling fluid or other fluid. In certain embodiments, filter unit 50 may include a filter formed of rings with shoulders such that the stacking of the rings creates small interstices that function to filter. In other embodiments, filter unit 50 may include a cylinder including slots, such as a one-piece cylinder including axially arranged slots.

The units of each module of modular control system 18 may be configured in any order. For example, within control module 30, navigation sensor unit 48 may be disposed upstream of control unit 46, while the embodiment illustrated in FIG. 3 includes navigation sensor unit 48 disposed downstream of control unit 46. Additionally, the units may be disposed within any of the modules of modular control system 18. For example, actuation unit 40 may be disposed within power module 28 as illustrated in FIG. 3 or within the control module.

Figure 4:
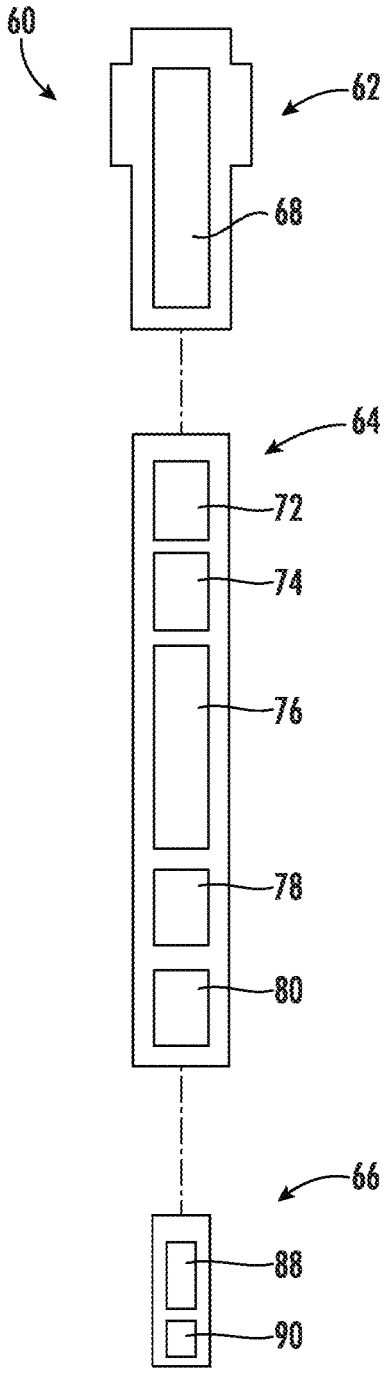
FIG. 4 is a schematic view of separated modules of a second configuration of the modular control system.

FIG. 4 illustrates a second configuration of the modular control system. Modular control system 60 may include power module 62, control module 64, and flow control module 66. Except as otherwise described, modular control system 60, along with the modules and units contained therein, may have substantially the same features and functions as modular control system 18. Power module 62 may include power unit 68 configured to generate electric power and/or electromagnetic field rotation. In the embodiment illustrated in FIGS. 5-7, power unit 68 may include impeller 70 that is rotationally secured to power sleeve 71. Impeller 70 may be sized and configured such that the outer ends of impeller 70 are closely proximate to an outer surface of cavity 20 in control sleeve 16 (as shown in FIG. 7). As a drilling fluid flows through cavity 20 of control sleeve 16, the drilling fluid flows through spaces in impeller 70, thereby applying a rotational force on impeller 70 and power sleeve 71. In this way, impeller 70 converts mechanical hydraulic power to electromagnetic field rotation.

Control module 64 may include communication unit 72, actuation unit 74, power supply unit 76, control unit 78, and navigation sensor unit 80. Communication unit 72 may be configured to provide communication to and from the rotary steerable system. In the embodiment illustrated in FIGS. 5-7, communication unit 72 may include antenna 82 for transmitting measurement data and other data to a measurement-while-drilling ("MWD") unit secured above the rotary steerable system, and the MWD unit may store the received data in a memory. Antenna 82 of the communication unit 72 may be formed of an electromagnetic antenna.

Figure 5:
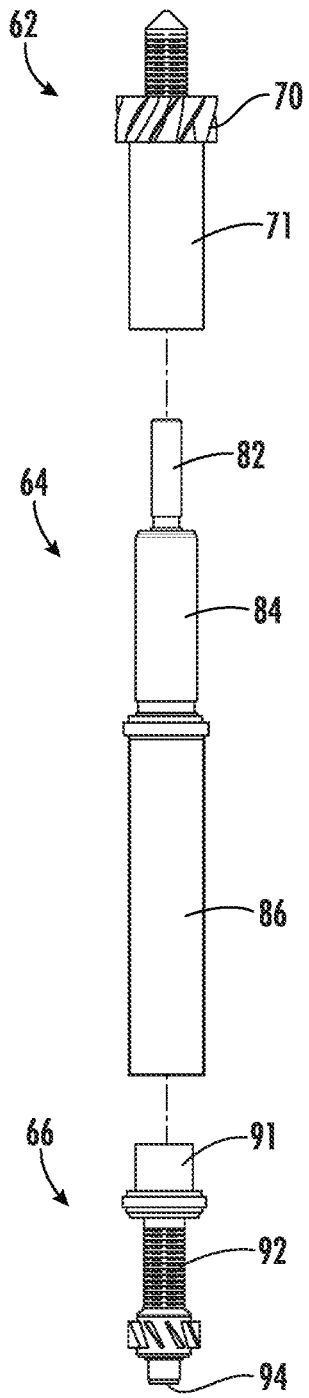
FIG. 5 is a side view of one embodiment of the modular control system's second configuration.
Figure 6:
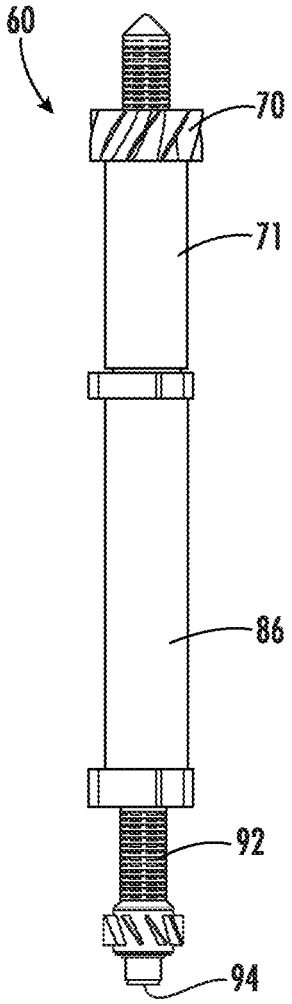
FIG. 6 is a side view of the modular control system in FIG. 5 assembled to fit within a control sleeve.
Figure 7:
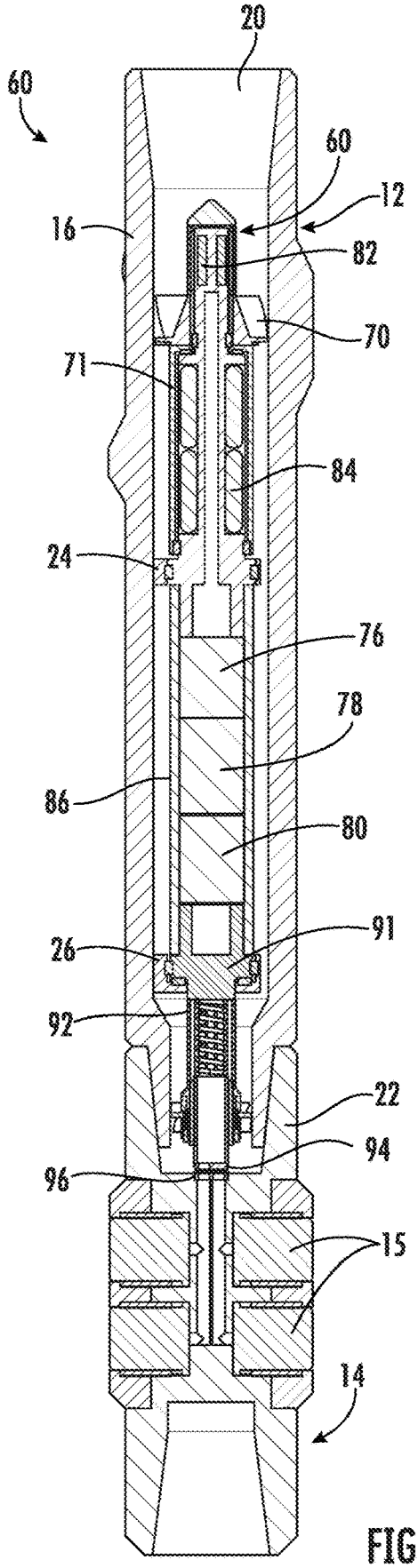
FIG. 7 is a sectional view of one embodiment of the rotary steerable system including the modular control system in FIG. 5 disposed within the control sleeve.

In the embodiment illustrated in FIGS. 5-7, actuation unit 74 disposed within control module 64 may include magnetic brake 84, which functions as an actuator to apply rotational torque in a direction that is opposite to a rotational direction of control sleeve 16 and steering housing 23. Magnetic brake 84 may apply rotational torque in response to the electromagnetic field rotation generated by impeller 70. In this way, actuation unit 74 within control module 64 adjusts the rotation rate of modular control system 60 relative to control sleeve 16 in response to an electromagnetic signal from power unit 68 in power module 62 (i.e., without any electrical wires or any other physical electrical connections extending across the connection between the power module 62 and the control module 64). In certain embodiments, magnetic brake 84 is the only actuator in the rotary steerable system.

Power supply unit 76 may be configured to power one or more units within control module 30 or other units within modular control system 18. Control unit 78 may be configured to adjust the position of modular control system 60 relative to steering section 14, which in turn controls actuation of the pistons 15 of steering section 14. For example, control unit 46 may be configured to adjust an actuator in actuation unit 40 based on measurements taken by sensors in navigation sensor unit 48. Navigation sensor unit 80 may be configured to orient the rotary steerable system relative to the surface. In the embodiment of FIGS. 5-7, power supply unit 76, control unit 78, and navigation sensor unit 80 may be contained within control housing 86. Navigation sensor unit 80 may include sensors disposed within control housing 86. For example, navigation sensor unit 80 may include a magnetometer for sensing a north-south direction, an accelerometer for sensing inclination, and a gyrometer for sensing rotation of the modular control system relative to a surrounding subterranean formation. Control unit 78 within control housing 86 may be configured to adjust the magnetic brake 84 based on measurements taken by the navigation sensor unit 80. Power supply unit 76 within control housing 86 may include batteries. In other embodiments, control module 64 includes no batteries and only a small amount of memory (e.g., flash memory only).

Flow control module 66 may include filter unit 88, flow distribution unit 90, and housing 91. Flow distribution unit 90 may be configured to divert a portion of the drilling fluid into the steering section 14 to actuate the pistons 15, while filter unit 88 may be configured to filter the diverted fluid. In the embodiment shown in FIGS. 5-7, filter unit 88 may include filter 92, and flow distribution unit 90 may include valve rotor 94. A portion of a drilling fluid flowing through cavity 20 of control sleeve 16 may flow through openings in filter 92, through one or more openings in valve rotor 94, and into one or more distribution passages leading to pistons 15. Filter 92 may be formed of rings with shoulders such that the stacking of the rings creates small interstices that function to filter. Valve rotor 94 may cooperate with a valve stator 96 of the steering section 14 to actuate the pistons 15. Valve rotor 94 rotates relative to the valve stator 96 as modular control system 60 rotates relative to control sleeve 16 and steering housing 23.

With the modules of modular control system 60 assembled as shown in FIGS. 6 and 7, antenna 82 and magnetic brake 84 of control module 64 may be positioned within power sleeve 71 of power module 62. This overlapping arrangement may form the first connection between power module 62 and control module 64. Control housing 86 of control module 64 may be threadedly connected to housing 91 of flow control module 66. This threaded connection may form the second connection between control module 64 and flow control module 66. A flat surface of valve rotor 94 of flow control module 66 may engage a flat surface of valve stator 96 of steering section 14. This sliding flat surface engagement may form the third connection between flow control module 66 and steering section 14. The assembled modular control system 60 may be secured to control sleeve 16 by the mechanical connection of fasteners 24 and 26, which engage control module 64 and power module 66, respectively.

Each of these connections is field detachable. The modular control system 60 may be detached from control sleeve 16 by disconnecting the fasteners 24 and 26 with hand tools only. Power module 62 may be easily detached from control module 64 by simply sliding the two modules apart. Control module 64 may be easily detached from flow control module 66 by unwinding the threaded connection with hand tools only, such as a wrench and vice. The third connection between flow control module 66 and steering section 14 may be easily detached by simply moving flow control module 66 away from steering section 14. In this way, each of the power module 62, control module 64, and flow control module 66 are modular and field detachable.

Figure 8:
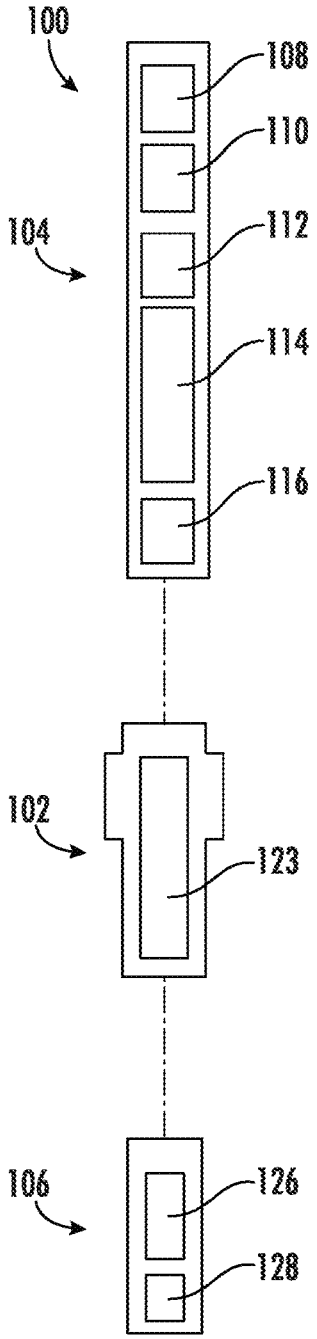
FIG. 8 is a schematic view of separated modules of a third configuration of a modular control system.
Figure 9:
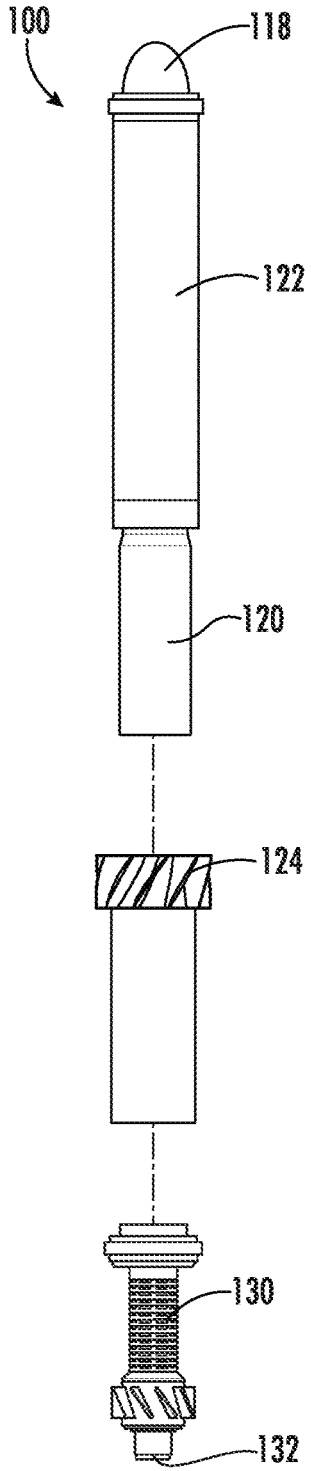
FIG. 9 is a side view of one embodiment of the modular control system's third configuration.
Figure 10:
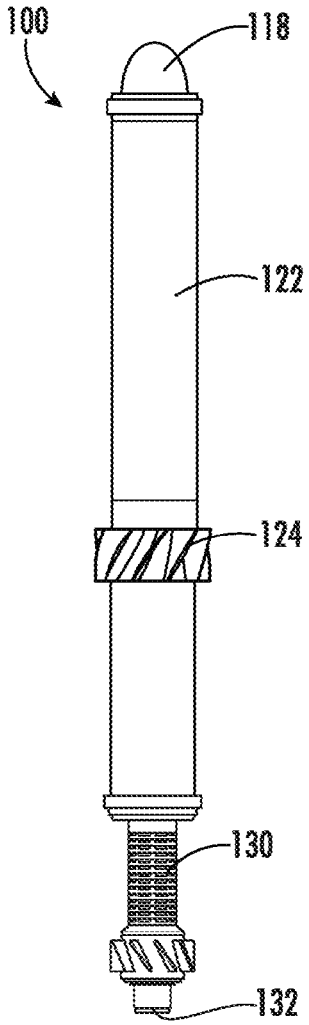
FIG. 10 is a side view of the embodiment of the modular control system shown in FIG. 9 assembled to fit within the control sleeve.

FIG. 8 illustrates a third configuration of the modular control system. Modular control system 100 may include power module 102, control module 104, and flow control module 106. Except as otherwise described, modular control system 100, along with the modules and units contained therein, may have substantially the same features and functions as modular control system 18 and modular control system 60. In modular control system 100, power module 102 is disposed between control module 104 and flow control module 106. Control module 104 includes communication unit 108, actuation unit 110, power supply unit 112, control unit 114, and navigation sensor unit 116. In the embodiment illustrated in FIGS. 9-10, communication unit 108 may include antenna 118, and actuation unit 110 may include magnetic brake 120. Power supply unit 112, control unit 114, and navigation sensor unit 116 may be disposed within control housing 122. Power module 102 of modular control system 100 includes power unit 123, which includes impeller 124 in the embodiment illustrated in FIGS. 9-10. Flow control module 106 of modular control system 100 may also include filter unit 126 and flow distribution unit 128, which correspond to filter 130 and valve rotor 132 in the embodiment illustrated in FIGS. 9-10, respectively.

In this third configuration of the modular control system, the first connection between the control module 104 and the power module 102 may be formed of a radial and thrust bearing connection, which is easily detachable by simply sliding the two modules apart. The second connection between the power module 102 and flow control module 106 may be formed of a threaded connection or any other type of mechanical connection, which is easily detachable with hand tools.

The modular control systems disclosed herein, including modular control systems 10, 60, and 100, are easily detachable from the other parts of the rotary steerable system. Similarly, each module of the modular control system is easily detachable from the other modules and the other parts of the rotary steerable system. The modular control system and its parts are configured to be handled by a single user due to their size and weight. For example but not by way of limitation, the modular control system may weigh less than 50 lbs. Accordingly, the modular control system can be detached from the other parts of the rotary steerable system without using a lift assist device, such as a crane. Similarly, the modules of the modular control system may be separated from one another without using a lift assist device. The modular control system and its parts are configured to be detached from other parts with no tools or with only hand tools, such as wrenches and vices. No motor-assisted torque equipment, such as break-out machines, are required to detach the modular control system from other parts of the rotary steerable system. Similarly, no motor-assisted torque equipment, such as break-out machines, are required to detach the modules from other modules within the modular control system.

The modularity of the modular control system is also supported by the mechanical nature of the connections among the separate modules and the connections between the modular control system and the remainder of the rotary steerable system. No electrical connections, such as electrical wires, extend across the connections between the modular control system and the remainder of the rotary steerable system. Similarly, no electrical connections extend across the connections between each module and the other modules of the modular control system. Accordingly, electrical connection manipulation or electrical wire manipulation is not required during the detachment process.

These features allow users to easily detach the modular control system from the remainder of the rotary steerable system, and to easily separate the individual modules from one another, for easy removal at a drilling location. The lack of electrical wires or connections between modules and parts allows a user to detach the modules in a location other than a clean, dry location. The modules may be detached at a drilling location that may be wet and/or dirty without affecting electrical connections. In this way, the modular control system and its modules are field detachable. The modularity of the modular control system and its modules allows field replacement of the modular control system or individual modules as necessary to maintain the rotary steerable system between jobs or between drilling runs. It also reduces the number of complete back up tools required at the drilling location.

As used herein, "upper" and "lower" are to be interpreted broadly to include "proximal" and "distal" such that the structures may not be positioned in a vertical arrangement. Additionally, the elements described as "upper" and "lower" may be reversed such that the structures may be configured in the opposite vertical arrangement. Except as otherwise described or illustrated, each of the components in this device has a generally cylindrical shape and may be formed of steel, another metal, or any other durable material. Portions of the rotary steerable system may be formed of a wear resistant material, such as tungsten carbide or ceramic coated steel.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. "Plurality" means two or more. "Above" and "below" shall each be construed to mean upstream and downstream, such that the directional orientation of the device is not limited to a vertical arrangement.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A rotary steerable system, comprising:

a steering section; and a control section, wherein the control section comprises a control sleeve having an internal cavity extending therethrough, a control housing disposed within the cavity, and a modular control system partially disposed within the control housing, wherein the modular control system is field detachable from the control sleeve.

2. The rotary steerable system of claim 1, wherein the modular control system includes a power module configured to generate electrical power or electromagnetic field rotation from hydraulic power, wherein the power module is field detachable from a remainder of the modular control system.

3. The rotary steerable system of claim 2, wherein the power module includes a power unit configured to generate electrical power or electromagnetic field rotation from hydraulic power.

4. The rotary steerable system of claim 3, wherein the power module further includes an actuation unit configured to actuate one or more pistons in the steering section in response to the electrical power or electromagnetic field rotation generated by the power unit.

5. The rotary steerable system of claim 2, wherein the modular control system further includes a control module configured to control the actuation of one or more pistons in the steering section, wherein the control module is field detachable from the power module.

6. The rotary steerable system of claim 5, wherein the control module includes an actuation unit configured to control the actuation of the one or more pistons in response to an electromagnetic field signal received from the power module, wherein no electrical wires extend across a connection between the control module and the power module.

7. The rotary steerable system of claim 6, wherein the control module further includes a navigation sensor unit and a control unit, wherein the navigation sensor unit includes one or more sensors configured to detect an orientation or position of the rotary steerable system relative to a surface location, wherein the control unit is configured to adjust the actuation unit in response to measurements taken by one or more sensors of the navigation sensor unit.

8. The rotary steerable system of claim 7, wherein the control module further includes a power supply unit and a communication unit, wherein the power supply unit is configured to power one or more other units within the control module, and wherein the communication unit includes an antenna.

9. The rotary steerable system of claim 5, wherein the modular control system further includes a flow control module configured to selectively allow fluid flow into one or more distribution channels leading to the one or more pistons in the steering section, wherein the flow control module is field detachable from the control module.

10. The rotary steerable system of claim 9, the flow control module includes a filter unit and a flow distribution unit, wherein the filter unit is configured to filter a fluid flowing to the flow distribution unit, and wherein the flow distribution unit is configured to divert a portion of a fluid flow to one or more distribution passages that lead to the one or more pistons in the steering section.

11. The rotary steerable system of claim 1 further comprising one or more fasteners, each of the one or more fasteners configured to removably secure the modular control system to the control sleeve.

12. The rotary steerable system of claim 1, wherein the modular control system comprises a plurality of modules, each module configured for detachable connection to one or more of the other modules.

13. A rotary steerable system, comprising:

a steering section; and a control section, wherein the control section includes a control sleeve having an internal cavity extending therethrough, a control housing disposed within the cavity, and a modular control system partially disposed within the control housing, wherein the modular control system comprises at least one module, wherein the modular control system is field detachable from the control sleeve, and wherein the at least one module is field detachable from a remainder of the modular control system.

14. The rotary steerable system of claim 13, wherein the at least one module includes a power module configured to generate electrical power or electromagnetic field rotation from hydraulic power, wherein the power module is field detachable from the remainder of the modular control system.

15. The rotary steerable system of claim 14, wherein the power module includes a power unit configured to generate electrical power or electromagnetic field rotation from hydraulic power.

16. The rotary steerable system of claim 15, wherein the power module further includes an actuation unit configured to actuate one or more pistons in the steering section in response to the electrical power or electromagnetic field rotation generated by the power unit.

17. The rotary steerable system of claim 13, wherein the at least one module includes a control module configured to control actuation of one or more pistons in the steering section, wherein the control module is field detachable from the remainder of the modular control system.

18. The rotary steerable system of claim 17, wherein the control module includes an actuation unit configured to control the actuation of the one or more pistons in response to an electromagnetic field signal received from the power module, wherein no electrical wires extend across a connection between the control module and the power module.

19. The rotary steerable system of claim 18, wherein the control module further includes a navigation sensor unit and a control unit, wherein the navigation sensor unit includes one or more sensors configured to detect an orientation or position of the rotary steerable system relative to a surface location, wherein the control unit is configured to adjust the actuation unit in response to measurements taken by the one or more sensors of the navigation sensor unit.

20. The rotary steerable system of claim 19, wherein the control module further includes a power supply unit and a communication unit, wherein the power supply unit is configured to power one or more other units within the control module, and wherein the communication unit includes an antenna.

21. The rotary steerable system of claim 13, wherein the at least one module includes a flow control module configured to selectively allow fluid flow into one or more distribution channels leading to one or more pistons in the steering section, wherein the flow control module is field detachable from the remainder of the modular control system.

22. The rotary steerable system of claim 21, the flow control module includes a filter unit and a flow distribution unit, wherein the filter unit is configured to filter a fluid flowing to the flow distribution unit, and wherein the flow distribution unit is configured to divert a portion of a fluid flow to one or more distribution passages that lead to the one or more pistons in the steering section.

* * * * *